US005112234A

United States Patent [19]

Johnson et al.

[11] Patent Number: 5,112,234

[45] Date of Patent: May 12, 1992

[54] PRINTED CIRCUIT CONNECTOR APPARATUS AND METHOD OF MAKING SAME

[75] Inventors: Larry K. Johnson, North Attleboro; Austin S. O'Malley, Rehoboth, both of Mass.

[73] Assignee: Texas Instruments Incorporated, Dallas, Tex.

[21] Appl. No.: 629,807

[22] Filed: Dec. 19, 1990

[51] Int. Cl.[5] ..... H01R 9/09

[52] U.S. Cl. ..... 439/79; 29/837; 29/845; 439/82; 439/853

[58] Field of Search ..... 29/837, 844, 845; 439/76, 78–82, 247, 248, 853

[56] References Cited

U.S. PATENT DOCUMENTS 4,050,769 9/1977 Ammon ..... 439/79

4,390,224 6/1983 Showman et al. ..... 439/79

4,425,015 1/1984 Rizzo ..... 439/83

4,697,864 10/1987 Hayes et al. ..... 439/79

*Primary Examiner*—Paula A. Bradley

*Attorney, Agent, or Firm*—John A. Haug; James P. McAndrews; Melvin Sharp

[57] ABSTRACT

A printed circuit board connector is shown having an elongated body of electrically insulating material in which several rows of apertures extend from a flat surface on one side, each row extending to one of a series of platforms on an opposite side spaced at progressively greater distances from the flat surface in order to accommodate contact pins having right angle bends with the same spacing beyond the right angle bend as on the flat surface. The contact pins received in the apertures communicating with the flat surface may be of the male pin or female receptacle type.

13 Claims, 4 Drawing Sheets

PRINTED CIRCUIT CONNECTOR APPARATUS AND METHOD OF MAKING SAME

This invention relates generally to printed circuit board connectors and more particularly to connector plugs mounting right angle pin or receptacle contacts which conform to specifications for military connectors. These are high quality connectors commonly referred to as F-Series connectors and comprise an elongated insulator body or plug having two or more rows of apertures which extend from a flat face on one side, e.g. the bottom, through the plug to a different level platform for each row on the opposite side of the plug going from a low platform to a progressively higher platform. A first straight portion of the pins is received in an aperture in the flat face and a second portion extends away from respective platforms of the plug at a right angle to the first portion.

Conventionally, for right angle plugs, pins are fabricated in a right angle (90°) configuration, dropped into the platform side of the aperture and locked into place by placement of epoxy in and adjacent the opening of each of the apertures at the platform. This is a highly labor intensive operation adding significantly to the cost of the operation. Further, the epoxy must be oven cured which adds to the processing time required to assemble the connector as well as causing undesirable bowing and warping problems.

It is an object of the present invention to provide a connector having right angle pins which conform to appropriate specifications for military connectors which is more conducive to low cost manufacturing procedures. Another object is the provision of a low cost, high reliability connector which takes less time to assemble than prior art procedures.

Briefly, in accordance with the invention, a row of straight contact pins each having a flange and preferably having a knurled portion along their length are inserted into apertures having at least two different diameter portions forming a shoulder therebetween. The contacts are inserted into the larger diameter portions on the flat side of the plug and pushed into the aperture until the flange abuts the shoulder with the knurled portion staked into the plug material. The row of pins extending out of the platform is then bent 90° to securely lock the pins into the plug. Subsequent individual rows of pins are mounted and configured in the same fashion.

DESCRIPTION OF THE DRAWINGS

Other objects, advantages and details of the novel and improved connector and method of manufacturing same provided by this invention appear in the following detail description of the preferred embodiments of the invention, the detail description referring to the drawing in which:

FIG. *7a* is a plan view of a pin, with the receptacle removed, which is receivable in the other rows of apertures.

With reference to FIG. 1 a cross sectional view of a conventional pin receptacle connector is shown comprising an insulator body or plug 10 having first, second and third rows of apertures 12, 14, 16 respectively (only one aperture per row being shown). Apertures 12, 14 and 16 are bores which extend from a flat surface on the bottom side 18 of plug 10 up to a larger diameter epoxy weld 20, 22, 24 on platforms 26, 28, 30 respectively formed on opposite side 32. Platforms 26, 28, 30 are formed progressively further away from side 18 so that connector pins which are formed with a right angle bend, inserted into the apertures, can extend away from a side of the plug with a preselected distance between rows, for example a spacing between rows on side 18 of 0.100 inch can be changed to 0.120 inch. Connector pins 34, 36, 38 respectively are generally composed of beryllium copper and preformed with a right angle bend and, in the version shown in FIG. 1, are provided with receptacles 40, 42, 44 respectively for reception of male pin members, however; these could also be male pins extending below end 18 to be received in female receptacles on a circuit board or other connector. The receptacle end of the pins are inserted in their respective apertures from the top side 32. It will be observed that the length of the pins for each row is different based on the location of the platform from bottom side 18 and the pins are inserted into their apertures as far as they can go until the male portion of the pin bottoms out against the plug. A measured amount of epoxy 46 is then injected into the epoxy well and the epoxy is then oven cured to securely lock the pins in place before the connector is ready for use.

Placing of epoxy in each individual pin location and allowing it to cure requires time and effort and forms a significant portion of the cost of the connector. Additionally, the epoxied pins present several other disadvantages. The epoxied pins are very rigid and if one or more pins is slightly out of alignment, caused for example by accidentally being hit by an object, it makes the task of placing the pins in mating apertures in a receiving body very difficult and can exacerbate the problem by bending the misaligned pin further out of alignment. Even if insertion is possible with pins slightly out of alignment the extra insertion force required is undesirable, particularly with the higher pin count such as 160 positions, for example. In the event that a pin is damaged so that it cannot be used the entire connector must be discarded.

Some of these problems have been overcome in prior art devices by forming a force fit of the pin in the bore of the connector body rather than epoxy to maintain the pins in their desired location. This arrangement however is unacceptable in some applications in which, for example, one or more of the receptacles of the connector body can be pushed out of the body upon having the connector forced onto pins having one or more slightly bent out of alignment.

Figure 1:
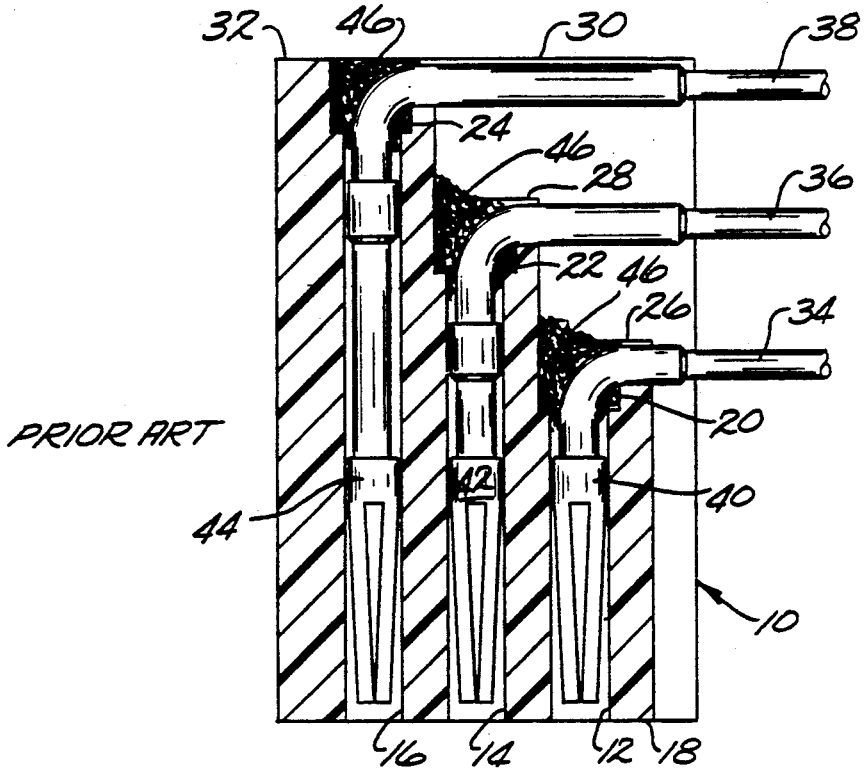
FIG. 1 is a cross sectional view taken through a prior art connector.
Figure 2:
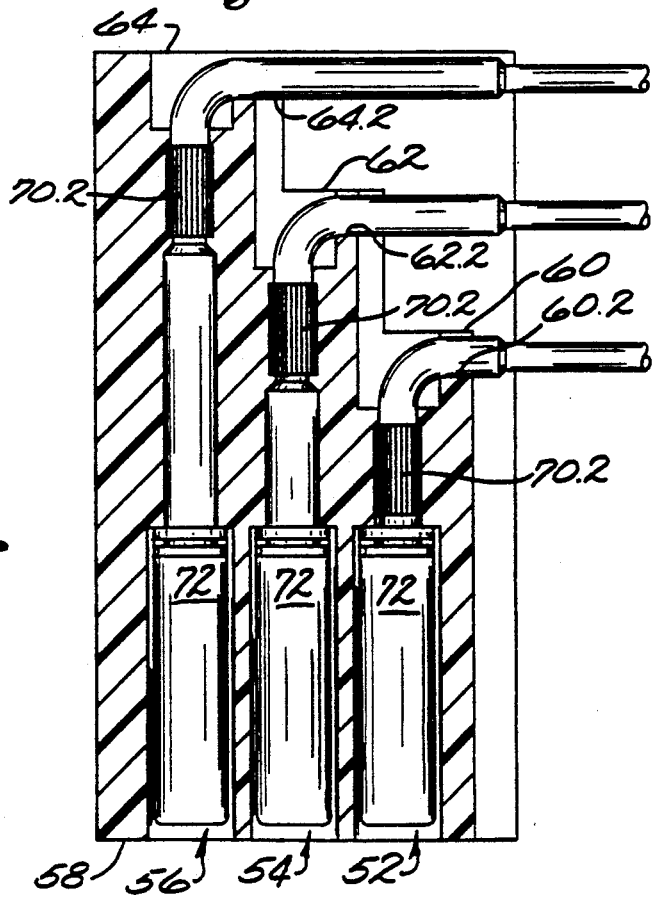
FIG. 2 is a view similar to FIG. 1 of a connector made in accordance with the invention.
Figure 3:
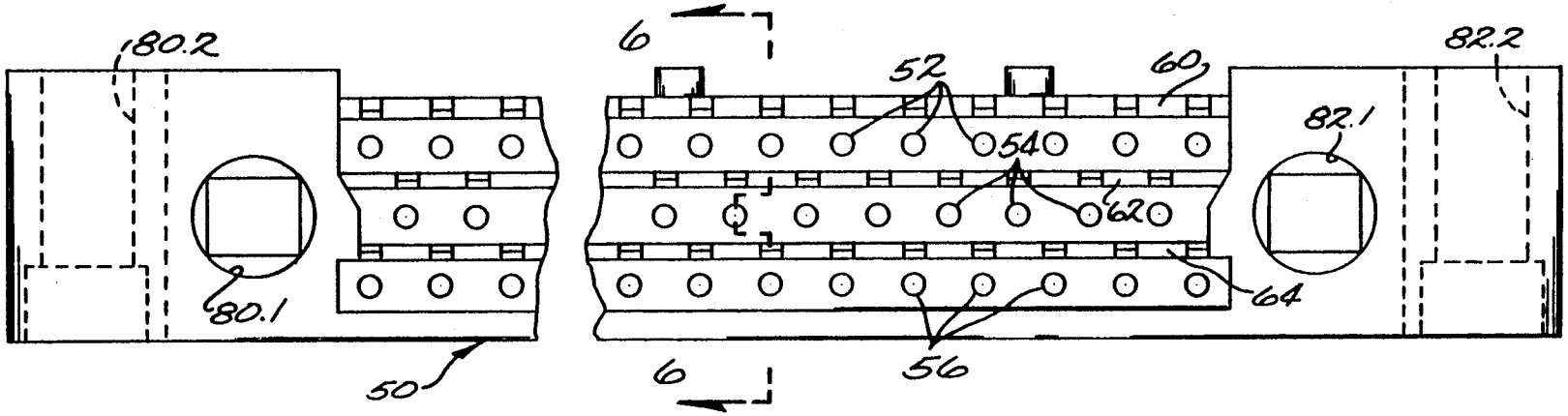
FIG. 3 is a top plan view of a connector insulator body or plug, broken away in the center, made in accordance with the invention.
Figure 4:
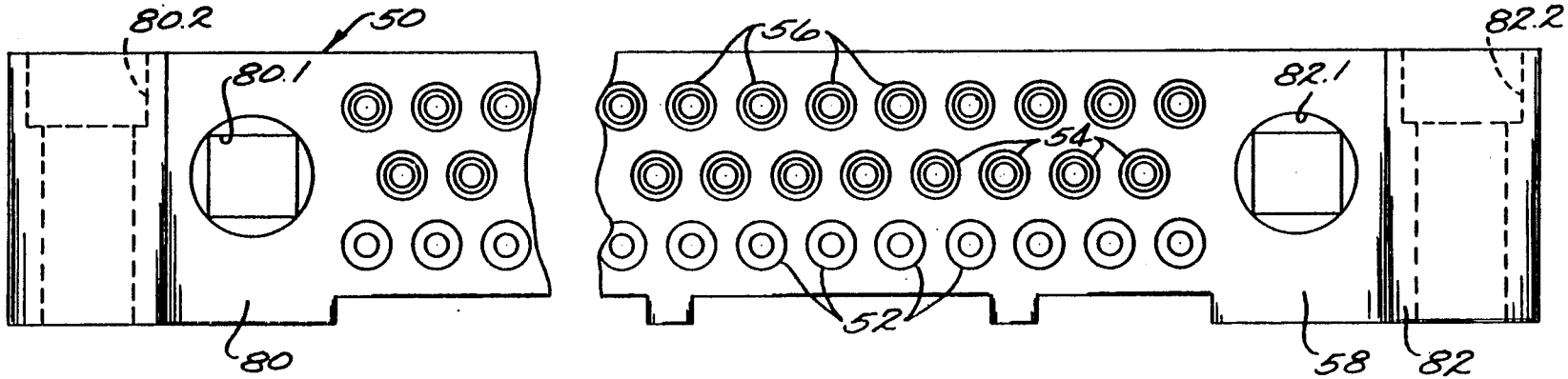
FIG. 4 is a bottom plan view of the FIG. 3 plug.
Figure 5:
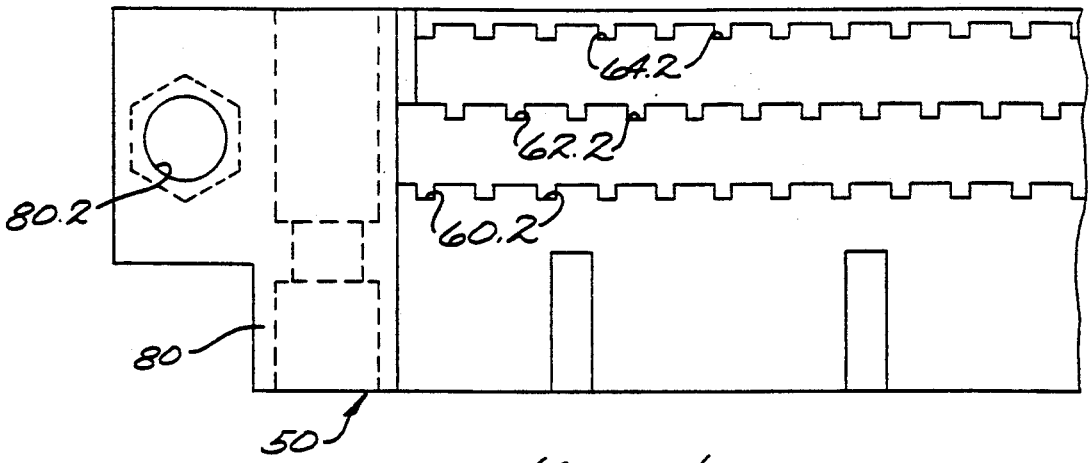
FIG. 5 is a front elevation of a portion of the FIG. 3, 4 plug.
Figure 6:
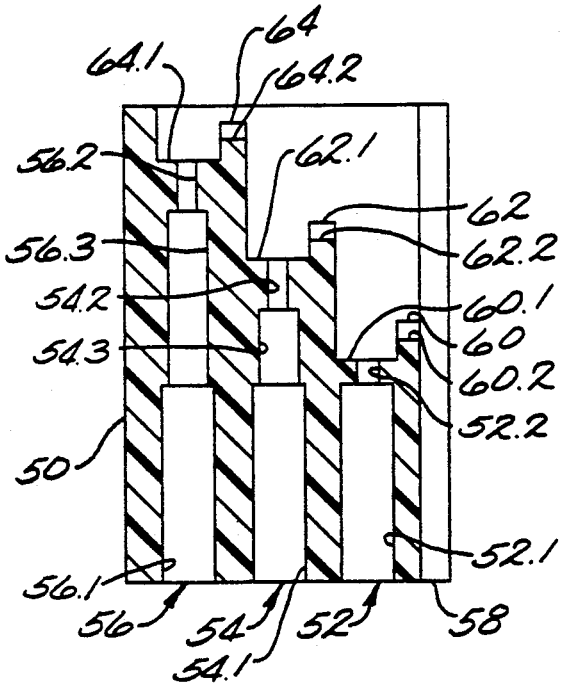
FIG. 6 is a cross sectional view taken on line 6—6 of FIG. 3.

A connector made in accordance with the invention, as shown in FIG. 2, overcomes the above mentioned problems as well as provides a substantially less costly device.

With particular reference to FIGS. 3-6, plug 50, formed of suitable material such as polyphenylene sulfide is provided with first, second and third rows of apertures 52, 54, 56 respectively, extending from a flat, bottom surface 58 to first, second and third platforms 60, 62, 64 respectively, progressively spaced further from bottom surface 58. Each aperture is formed by a bore having a first selected equal diameter 52.1, 54.1 and 56.1 communicating with surface 58 culminating with a second, equal but smaller diameter 52.2, 54,2, 56.2 respectively, communicating with recessed areas 60.1, 62.1, 64.1 of respective platform 60, 62, 64. Apertures 54 and 56 have an intermediate size bore 54.3, 56.3 to receive a correspondingly shaped pin.

Cut out portions or slots 60.2, 62.2, 64.2 respectively having a width corresponding to the male pin portion, are formed in the front wall forming recesses 60.1, 62.1, 64.1 respectively in alignment with each respective bore.

Figure 7:
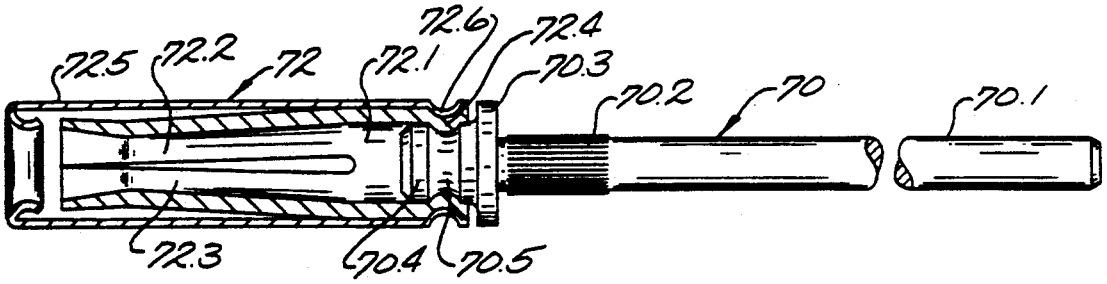
FIG. 7 is a plan view of a receptacle pin receivable in one row of apertures of the FIG. 3–5 plug shown with the receptacle portion in cross section.

Pin 70, shown in FIG. 7, has a male pin portion 70.1, has a mounting portion such as a knurled portion 70.2 along a selected portion of its length, an outwardly extending flange 70.3 and a receptacle attachment portion 70.4 including a groove 70.5. Receptacle 72 comprises a tubular spring contact 72.1 having first and second split-tubular portions 72.2, 72.3 having an inner diameter portion which in its at rest position, is smaller than the diameter of the male pin portion which is to be received between portions 72.2, 72.3 by forcing the portions apart to effect a good electrical connection therebetween. Spring contact 72.1 is formed with an inwardly extending circular rib 72.4 which is received in groove 70.5 to join receptacle 72 to pin 70. A cylindrical sheath 72.5, also having an inwardly extending circular rib 72.6 is preferably placed about spring contact 72.1 with rib 72.6 received in a corresponding groove formed in spring contact 72.1 on the outside surface of rib 72.4.

Each pin 70 is received in an aperture 52 and is inserted from bottom surface 58 and pushed in until shoulder 70.3 bottoms out against the shoulder formed between bores 52.1 and 52.2 with knurled portion 70.2 of the pin being forced, or staked, into the plug material defining bore 52.2. The knurled portion conveniently maintains the pins in their proper locations during processing however, alternatively, the location of the pins could be maintained by ultrasonic or heat staking. After shoulder 70.3 has bottomed out the male portion 70.1 is bent 90° through slot 60.2 which then locks the pin in place.

Figure 7A:
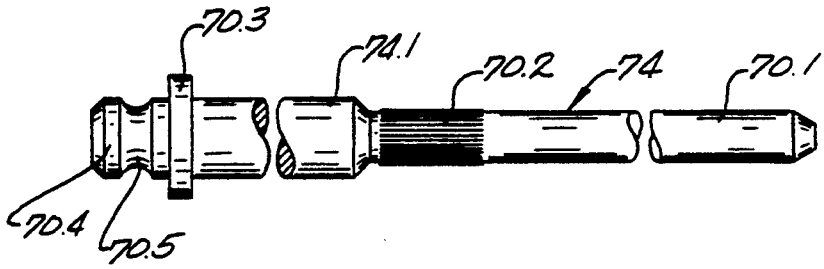

In a similar manner pins 74 of appropriate lengths are placed first into row 54 and bent 90° through slot 62.2 and then into row 56 and bent 90° through slot 64.2. As seen in FIG. 7*a* pins 74 have a male pin portion 70.1, a knurled portion 70.2 along a portion of its length, a shoulder 70.3, a receptacle attachment portion 70.4 with attachment groove 70.5 all as included on pin 70 of FIG. 7, however; pin 74 also has an enlarged diameter portion 74.1 which is receivable in diameter 54.3 or 56.3 depending on the specific length of portion 74.1 and male portion 70.1. The lengths of these portions are selected to provide a selected distance between rows of pin receptacles and bottom face 58 which generally is different from the spacing of the rows on the other side of the 90° bend in the contacts.

The pin material may be a phosphor bronze or brass such as CA173 with a nickel and gold plating. Spring contact 72.1 is preferably formed of beryllium copper for its spring characteristics and plated with gold. Sheath 72.5 may be formed of a copper alloy and plated with gold if desired.

Plugs 50 are provided in different lengths to accommodate a number of different pin counts, for example from 10 to 160, and generally has two or three rows of apertures although more rows could be provided if desired. Spacing between pins in a given row is a matter of choice but a typical standard is 0.075 inches between center lines. Pin apertures of one row are offset relative to the pin apertures of an adjacent row in order to maximize spacing between the pins of one row with the pins of the adjacent row. Plugs 50 are shown provided with optional mounting ears 80, 82 having mounting apertures 80.1, 82.1 and 80.2, 82.2 aligned with the direction of the respective receptacles and male pin portions for attachment to circuit boards and the like.

Figure 8:
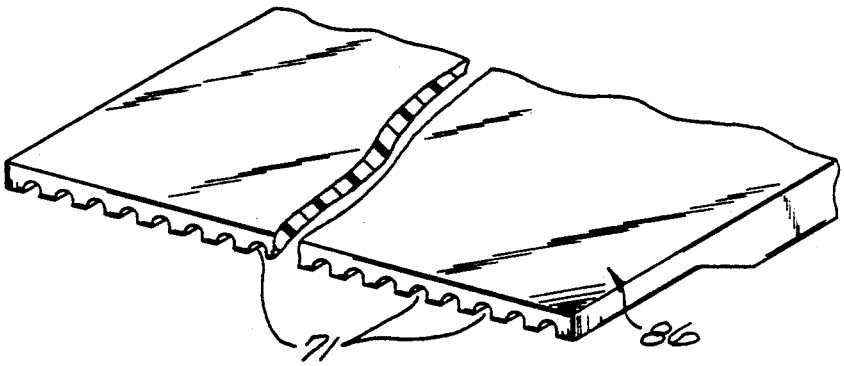
FIG. 8 is a perspective view of a tool useful in bending a row of pins after assembly into the plug.

In manufacturing the connectors the pins of a given row, starting with the platform closest to the bottom surface, are inserted preferably simultaneously using a suitable transport mechanism and then a tool 86 (FIG. 8) having a plurality of pin receiving slots 71 is placed in back of the pins on a respective platform 60, 62, 64 with the pins received in respective slots 71 and the tool is pivoted sufficiently to bend the plurality of male pin portions 70.1 approximately 90°. Subsequent rows of pins are assembled and bent in the same manner.

Once the leads are bent they are securely locked into place with shoulder 70.3 preventing movement in one direction and the right angle bend preventing movement in the opposite direction. Yet if a lead is damaged for some reason the lead can be removed and replaced without having to discard the entire connector. Yet another advantage that the invention provides is that the distal ends of male pin portion 70.1 tend to float resulting in a self aligning feature. That is, if a pin is not perfectly in alignment with a mating receptacle the floating arrangements is much more conducive to allowing the pin to be cammed into alignment than is the case with the more rigid epoxied pins of the prior art.

Although the specific embodiment described in FIGS. 2-7 relate specifically to receptacle connectors it will be realized that the connector can also be used with pins extending from both sides of the plug if desired.

It should be understood that although particular embodiments of the connector and methods of the invention have been described by way of illustrating the invention, the invention includes all the modifications and equivalents of the described embodiments falling within the scope of the appended claims.

We claim:

1. A printed circuit board connector comprising an elongated body of electrically insulative material having a flat bottom surface and having a plurality of platforms formed in an opposite surface of the body, the platforms being spaced progressively further away from the flat bottom surface, a plurality of rows of apertures formed in the body in communication with the flat bottom surface, each row of apertures extending to a different platform, each aperture being a bore having first and second diameters, the second smaller than the first, the first diameter bore being in communication with the flat bottom surface and the second diameter bore being in communication with one of the platforms, a shoulder being formed between the first and second bores, a generally cylindrical contact pin having first and second ends and having a mounting portion along a portion of its length intermediate its ends the mounting portion being knurled, the diameter of the knurled portion being selected to be slightly larger than the second diameter bore, an outwardly extending flange formed on each pin, a pin received in each aperture with the mounting portion received in the second diameter bore and the flange bottomed out against the shoulder, an end of the pin extending out of the second diameter bore and being bent 90° along the platform.

2. A printed circuit board connector according to claim 1 in which the body is composed of polyphenylene sulfide.

3. A printed circuit board connector according to claim 1 in which the pin is composed of brass.

4. A printed circuit board connector according to claim 1 in which the pin is composed of phosphor bronze.

5. A printed circuit board connector according to claim 1 in which a tubular spring contact is received on the other end of the pin and is disposed in the first diameter bore to form a receptacle contact.

6. A printed circuit board connector comprising an elongated body of electrically insulative material having a flat bottom surface and having a plurality of platforms formed in an opposite surface of the body, the platforms being spaced progressively further away from the flat bottom surface, a plurality of rows of apertures formed in the body in communication with the flat bottom surface, each row of apertures extending to a different platform, each aperture being a bore having first and second diameters, the second smaller than the first, the first diameter bore being in communication with the flat bottom surface and the second diameter bore being in communication with one of the platforms, a shoulder being formed between the first and second bores, a generally cylindrical contact pin having first and second ends and having a mounting portion along a portion of its length intermediate its ends, an outwardly extending flange formed on each pin, a pin received in each aperture with the mounting portion received in the second diameter bore and the flange bottomed out against the shoulder, an end of the pin extending out of the second diameter bore and being bent 90° along the platform, a tubular spring contact received on the other end of the pin and being disposed in the first diameter bore to form a receptacle contact and a tubular sheath received over the spring contact.

7. A printed circuit board connector according to claim 6 in which the spring contact is formed of beryllium copper.

8. A printed circuit board connector according to claim 7 in which the pin is composed of brass.

9. A printed circuit board connector according to claim 7 in which the pin is composed of phosphor bronze.

10. A method for making a printed circuit board connector having male pin portions extending from the connector which float comprising the steps of providing an electrically insulative body, forming a row of apertures extending from one side of the body to an opposite side, the bores having first and second diameter bore portions, the first diameter being larger than the second diameter, forming a shoulder in each aperture, forming a generally cylindrical pin of bendable material, forming an outwardly extending flange on the pin, forming a knurled portion around the periphery of the cylindrical pin along a portion of its length, the diameter of the knurled portion being slightly larger than the second diameter bore portion and inserting the pins into the apertures from one side and limiting the motion of the pin by bottoming out the flange against the shoulder while forcing the knurled portion into the second diameter portion and thereafter taking a portion of the pin extending out of the body on the opposite side and bending the pin 90°, the knurled portion serving to maintain the pin in its desired location while the pin is being bent.

11. A method according to claim 10 in which the body is formed of polyphenylene sulfide.

12. A method according to claim 10 in which the pin is formed of brass.

13. A method according to claim 10 in which the pin is formed of phosphor bronze.

* * * * *